US007849625B2

(12) United States Patent
Ligard

(10) Patent No.: US 7,849,625 B2
(45) Date of Patent: Dec. 14, 2010

(54) GUN BARREL LOCK

(76) Inventor: Thor H. Ligard, 8817 S. 92 E. Pl., Tulsa, OK (US) 74133

( * ) Notice: Subject to any disclaimer, the term of this patent is extended or adjusted under 35 U.S.C. 154(b) by 1231 days.

(21) Appl. No.: 10/980,414

(22) Filed: Nov. 3, 2004

(65) Prior Publication Data

US 2006/0101696 A1 May 18, 2006

(51) Int. Cl.
*F41A 17/02* (2006.01)

(52) U.S. Cl. ..... 42/70.11; 42/70.01

(58) Field of Classification Search ..... 42/70.11, 42/70.01; *F41A 17/02, 17/44*
See application file for complete search history.

(56) References Cited

U.S. PATENT DOCUMENTS

| | | | | | |
|---|---|---|---|---|---|
| 2,327,334 | A * | 8/1943 | Parker | 42/70.11 |
| 2,836,918 | A * | 6/1958 | Pula et al. | 42/70.11 |
| 4,398,366 | A * | 8/1983 | Wernicki | 42/70.11 |
| 4,969,284 | A * | 11/1990 | Healey et al. | 42/70.11 |
| 5,138,785 | A * | 8/1992 | Paterson | 42/66 |
| 5,289,653 | A * | 3/1994 | Szebeni et al. | 42/70.11 |
| 5,491,918 | A * | 2/1996 | Elmstedt | 42/70.11 |
| 5,664,358 | A * | 9/1997 | Haber et al. | 42/70.11 |
| 5,699,687 | A * | 12/1997 | Pittman | 70/376 |
| 5,890,310 | A * | 4/1999 | Bogstrom | 42/70.11 |
| 6,223,566 | B1 | 5/2001 | Jamison | |
| 6,311,422 | B1 | 11/2001 | Exum et al. | |
| 6,405,472 | B1 | 6/2002 | Dojesak | |
| 6,560,910 | B1 | 5/2003 | McLaren | |
| 6,604,313 | B1 * | 8/2003 | Kress | 42/70.11 |
| 6,701,655 | B2 | 3/2004 | Milo | |
| 6,796,071 | B2 * | 9/2004 | Lane et al. | 42/70.11 |
| 2002/0121039 | A1 * | 9/2002 | Kellerman | 42/70.11 |
| 2002/0152662 | A1 * | 10/2002 | Lane et al. | 42/70.11 |

FOREIGN PATENT DOCUMENTS

| | | | |
|---|---|---|---|
| GB | 2082293 | A * | 3/1982 |
| WO | WO 9206345 | A1 * | 4/1992 |

* cited by examiner

*Primary Examiner*—Bret Hayes
(74) *Attorney, Agent, or Firm*—Gable Gotwals

(57) ABSTRACT

A lock for a gun barrel has plugs insertable into the chamber and muzzle. The plugs impinge against existing stops on the barrel so as to limit travel of the plugs toward each other in the barrel. Once the plugs are in the barrel, a linkage connects them so that each stop prevents removal of the opposite plug from the barrel. Preferably the stops, such as the chamber diameter reduction and the muzzle choke seat, are inside the barrel and the length of each plug is coordinated with the distance to its in-barrel stop so that no part of the gun barrel lock is exposed to out-of-bore tampering. A lock prevents unauthorized disengagement of the linkage from the plugs. The gun barrel lock is of adjustable length and the plugs may have interchangeable diameter adapters to accommodate a variety of gun barrel lengths and calibers.

26 Claims, 5 Drawing Sheets

GUN BARREL LOCK

BACKGROUND OF THE INVENTION

This invention relates generally to accessories for firearms and more particularly concerns locks for plugging gun barrels.

The use of a lockable plug as a deterrent to unauthorized use or inadvertent or accidental discharge of a gun is well known. Such plugs typically rely on some form of inside-of-the-barrel plug expansion or outside-of-the-barrel plug compression to secure the plug in the barrel.

Plugs which radially expand within the barrel typically rely on frictional engagement against the circumferential wall of the barrel to resist removal of the plug from the barrel. They require complex expanding mechanisms in order to achieve sufficient frictional contact between the barrel and plug surfaces and, while the plug is in the barrel, a substantial portion of their operating structure is usually exposed to tampering outside of the barrel. While they are difficult for the user to install and remove, they offer only modest resistance to unauthorized removal of the plug from the barrel. Since, by definition, their expanding components must exert significant force against the barrel wall, they may all too easily mar or more severely damage the barrel surface in normal use. Because of the complexity of the expanding mechanisms, they generally can be used only with the specific caliber of weapon or length of barrel for which they are designed. In order to provide a more secure locking engagement than is possible with friction type expansion plugs, one variation of the expanding plug approach relies on radial expansion of locking pins. The plug is inserted through a narrow diameter portion of the barrel and the pins then extend into a wider diameter annular groove in the barrel. This grooving is, however, an unacceptable compromise of the barrel wall.

Plugs which operate by radial compression are generally inversions of the expanding plugs above described. They generally combine an in-the-barrel plug with an outside-the-barrel mechanism to secure the plug in place. The plug does not expand against the inner wall of the barrel. It only blocks the passage. It is held in place by an external structure. Some external structures frictionally grip the outer surface of the barrel. Others engage against a protrusion from the barrel to prevent removal. By reason of their compressive forces they, like the expansion plugs, are likely to mar or more severely damage the barrel, though at least only on the outside wall. However, these devices expose most, if not all, of the locking mechanism to outside-of-the-barrel tampering.

It is, therefore, an object of this invention to provide a gun barrel lock which deters unauthorized use and accidental or inadvertent discharge of a gun. Another object of this invention is to provide a gun barrel lock which is easily installed and removed by an authorized user. A further object of this invention is to provide a gun barrel lock which is substantially contained within the barrel. Yet another object of this invention is to provide a gun barrel lock which has most of its structure shielded from exposure to outside-the-barrel tampering. It is also an object of this invention to provide a gun barrel lock which does not exert radial forces against the inside wall of the barrel. Still another object of this invention is to provide a gun barrel lock which can be adjusted to accommodate barrels of different caliber. An additional object of this invention is to provide a gun barrel lock which can be adjusted to accommodate barrels of different length.

SUMMARY OF THE INVENTION

In accordance with the invention a lock is provided for a gun barrel. A first plug is insertable into the chamber end of the gun barrel. A second plug is insertable into a muzzle end of the gun barrel. The plugs are adapted to impinge against portions of the barrel in their path during insertion so as to limit travel of the plugs toward each other in the barrel. A linkage is fixed at one end to one of the plugs and extends to and is adapted at the other end for engagement with the other plug so that the impingement of each plug against its associated barrel portion prevents removal of the other plug from the barrel. A lock prevents unauthorized disengagement of the adapted end of the linkage from its associated plug. Preferably, the linkage is of adjustable length to accommodate a variety of gun barrels.

In a preferred embodiment, cooperative means are provided on the in-bore ends of each plug for mating the plugs for simultaneous rotation about a longitudinal axis. The linkage is journalled at one end on one of the plugs for extension into the other plug. Cooperative means are also provided on the linkage and the other plug for coupling the plugs against longitudinal separation so that impingement of each plug prevents removal of the other plug from the barrel. The lock secures the linkage against rotation in its plug so as to prevent unauthorized disengagement of the linkage.

For a barrel end of constant diameter, such as the muzzle end of a hand gun or rifle, it is preferred that its associated plug have a flange for impingement against the corresponding outer end of the barrel. For gun barrels having a chamber with a chamfer at its outer end and a diameter reduction at its in-barrel end, it is preferred that its chamber plug have a stop for impingement against the chamfer or reduction inside the barrel. For gun barrels having a choke seat in the muzzle, it is preferred that its muzzle plug have a stop for impingement against the choke seat. Most preferably, the length of each plug will be coordinated with the distance from its end of the barrel to its in-barrel stop so as to stop travel of the plug into the barrel only after the plug is disposed entirely within the bore. In this configuration, no part of the gun barrel lock is exposed to out-of-bore tampering.

In order to adapt the gun barrel lock to a variety of gun calibers, the chamber plug may be made in two parts, a casing with a pocket and a housing with a post. The post is slidable in the pocket and a setscrew may be used to fix the post at any position in the pocket. Casings with different outer diameters for use with different caliber barrels all have identical pockets. The casings are readily interchangeable on the housing to convert a plug to a particular gun caliber. Similarly, the muzzle plug may be made in two parts, a body and a ring thereabout. Rings with a different outer diameter for use with different caliber barrels all have identical inside diameters. The rings are readily interchangeable on the body to convert a plug to a particular gun caliber.

In another embodiment of the gun barrel lock, the lock cylinder is mounted for rotation in the chamber plug with the locking member seat located in its in-bore end. The muzzle plug has a shaft extending to a locking member fixed at its in-bore end. The locking member is longitudinally insertable into and engagable for rotation with the locking member seat for coupling the plugs against longitudinal separation.

BRIEF DESCRIPTION OF THE DRAWINGS

Other objects and advantages of the invention will become apparent upon reading the following detailed description and upon reference to the drawings in which.

Figure 1:
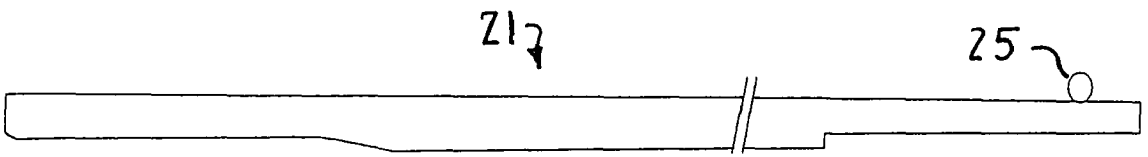
FIG. 1 (PRIOR ART)
FIG. 1 is a diametric cross-sectional view of a typical shotgun barrel.

While the invention will be described in connection with preferred embodiments thereof, it will be understood that it is not intended to limit the invention to those embodiments or to the details of the construction or arrangement of parts illustrated in the accompanying drawings.

DETAILED DESCRIPTION

The gun barrel lock herein described may be used with hand guns, rifles or shotguns. It is described in relation to use with a shotgun barrel 21. The barrel 21, illustrated in FIG. 1, has a bore 22 extending between its chamber 23 and muzzle 24. A sight 25 is fixed atop the muzzle 24. The in-bore end of the chamber 23 is tapered to form a chamber reduction 26 as is necessary for receiving a shotgun shell. The outer end of the chamber 23 has a chamfer 27 for the rim of the shell casing. In modern shotguns, the muzzle 24 may be widened to form a choke seat 28. Older shotgun barrels do not have a choke seat 28. The chamber reduction 26, chamfer 27 and choke seat 28 are significant to the present disclosure because they can be used as stops to impinge against components of various embodiments of the gun barrel lock 31.

Figure 3:
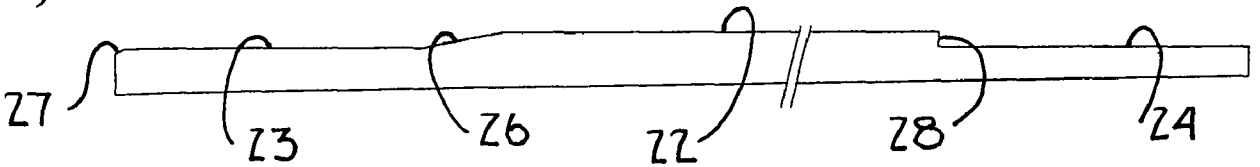
FIG. 3 is a vertical plane diametric cross-sectional view of the plug assembly of the gun barrel lock of FIG. 2.
Figure 3:
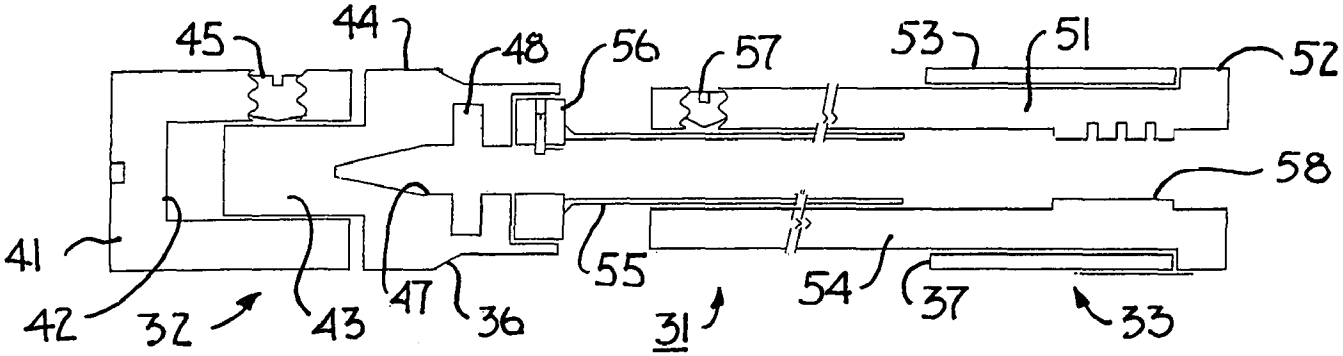
Figure 4:
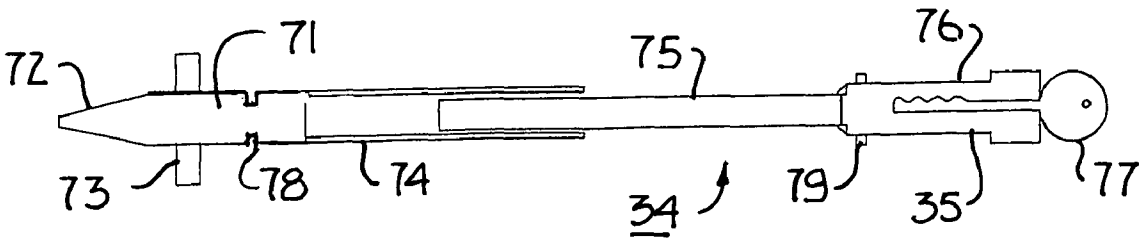
FIG. 4 is a vertical plane diametric cross-sectional view of the lock assembly of the gun barrel lock of FIG. 2.
Figure 2:
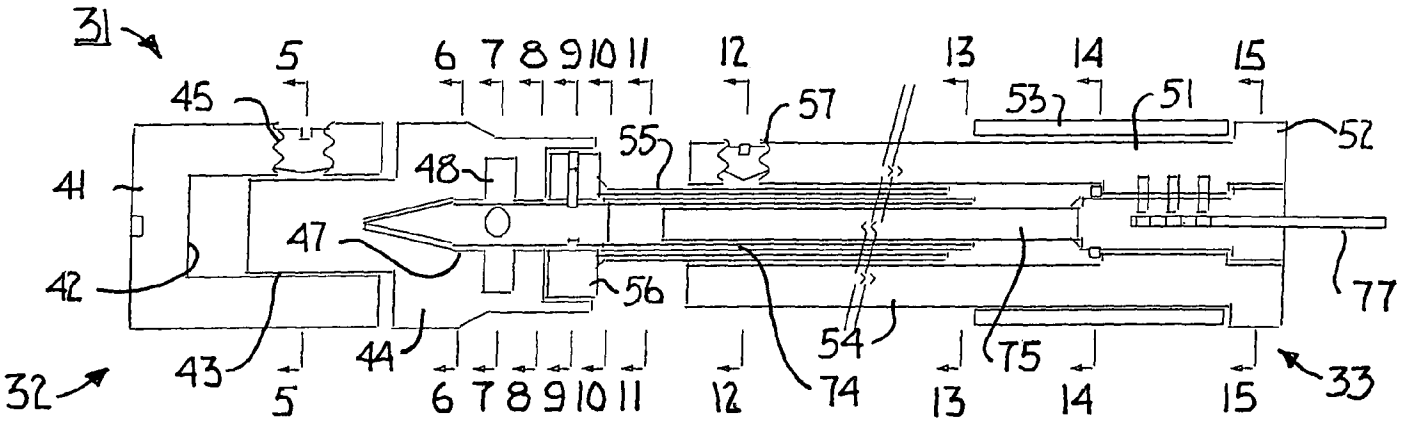
FIG. 2 is a vertical plane diametric cross-sectional view of the assembled gun barrel lock.

Turning to FIGS. 2-4, an embodiment of the gun barrel lock 31 is illustrated which is particularly suited for use with the shotgun barrel 21 shown in FIG. 1. The gun barrel lock 31 consists essentially of a chamber plug 32, a muzzle plug 33 and a linkage 34. The linkage 34 interconnects the plugs 32 and 33 and has a lock 35 to reduce the likelihood of unauthorized disconnection.

Looking at FIGS. 1-3, the diameter of the chamber plug 32 is such that the plug 32 is insertable into the chamber 23 of the barrel 21. The chamber plug 32 has a conical surface 36 which reduces the plug diameter so that the in-bore end of the plug 32 can pass through the chamber reduction 26 until the conical surface 36 impinges against the chamber reduction 26. The impingement of the conical surface 36 against the chamber 26 prevents further travel of the chamber plug 32 into the barrel 21. The diameter of the muzzle plug 33 is such that the plug 33 is inserted into the muzzle 24 of the barrel 21. The in-bore portion of the muzzle plug 33 has a peripheral land 37 which impinges against the choke seat 28 as the muzzle plug 33 is inserted into the muzzle 24. The impingement of the peripheral land 37 against the muzzle stop 28 prevents further travel of the muzzle plug 33 into the barrel 21. Thus, when the linkage 34 interconnects the chamber plug 32 and the muzzle plug 33, each plug 32 or 33 opposes the removal of the other plug 33 or 32 from the barrel 21.

Figures 5, 6, 7, 8, 9, 10:
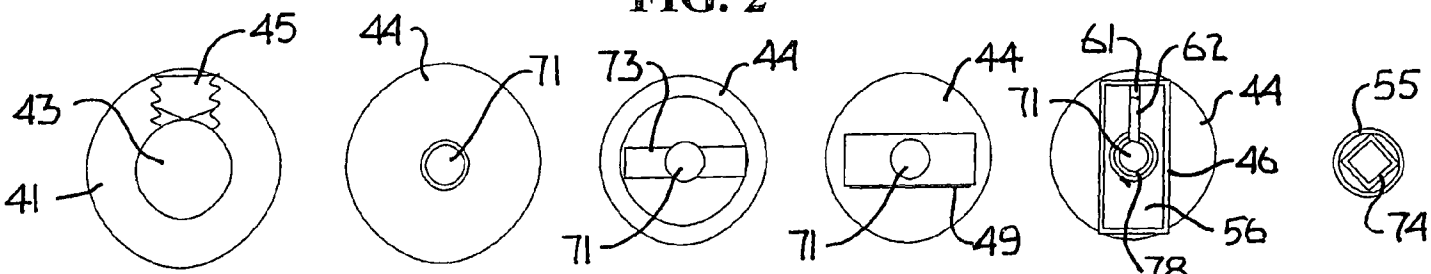
FIG. 5 is a cross-sectional view taken along the line 5-5 of FIG. 2.
FIG. 6 is a cross-sectional view taken along the line 6-6 of FIG. 2.
FIG. 7 is a cross-sectional view taken along the line 7-7 of FIG. 2.
FIG. 8 is a cross-sectional view taken along the line 8-8 of FIG. 2.
FIG. 9 is a cross-sectional view taken along the line 9-9 of FIG. 2.
FIG. 10 is a cross-sectional view taken along the line 10-10 of FIG. 2.
Figures 11, 12, 13, 14, 15:
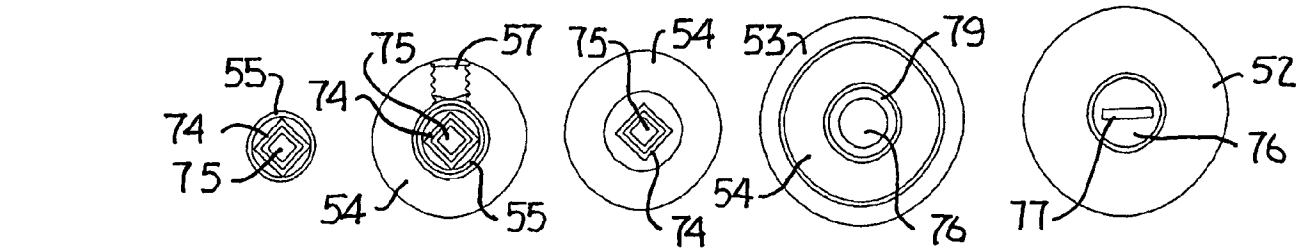
FIG. 11 is a cross-sectional view taken along the line 11-11 of FIG. 2.
FIG. 12 is a cross-sectional view taken along the line 12-12 of FIG. 2.
FIG. 13 is a cross-sectional view taken along the line 13-13 of FIG. 2.
FIG. 14 is a cross-sectional view taken along the line 14-14 of FIG. 2.
FIG. 15 is a cross-sectional view taken along the line 15-15 of FIG. 2.

Looking at FIGS. 2, 3 and 5-9, the chamber plug 32 has a casing 41 which is preferably similar in its outer configuration to the casing of a shotgun shell that would be loaded into the chamber 23. The casing 41 has a pocket 42 which receives a post 43 extending from a locking member housing 44. The post 43 slides longitudinally in the pocket 42 and a set screw 45 is used to secure and release the casing 41 to and from the housing 44. Thus, the set screw 45 can be used to adjust the length of the chamber plug 32 or to allow casings 41 and housings 44 to be interchanged. The chamber plug 32 has a seat 46 of non-circular cross-section accessible from the internal end of the plug 32. As shown in FIG. 9, the seat cross-section is rectangular.

Looking at FIGS. 2, 3 and 9-16, the muzzle plug 33 has a body 51 with an annular flange 52 of outer diameter less than the inner diameter of the muzzle 24. A ring 53 slides over the body 51 against the flange 52. The diameter of the ring 53 is greater than the diameter of the bore 22 of the barrel 21 at the muzzle stop 28 but less than the diameter of the muzzle 24. In this embodiment, the in-bore face of the ring 53 is the peripheral surface 34 which will impinge against the muzzle stop 28. The body 51 of the muzzle plug 33 has a sleeve 54 extending from the in-bore end of the body 51 into the barrel 21. The inside diameter of the sleeve 54 is coordinated to slide on the outside diameter of a circular tube 55 so as to telescope the length of the muzzle plug 33. The circular tube 55 has a block 56 welded to its free end. The block 56 is shaped to be seated in and complement the seat 46. As best seen in FIG. 9, the block 56, like the seat 46, is rectangular. Since the seat 46 and the block 56 are non-circular, when the block 56 is in the seat 46, rotation of the circular tube 55 will cause in-unison rotation of the housing 44. The casing 41, which is secured to the post 43 by the set screw 45, will also rotate in unison with the circular tube 55. By telescoping the circular tube 55 in the sleeve 54, the distance between the conical surface 36 of the chamber plug 32 and the peripheral land 37 of the muzzle plug 33 can be adjusted to conform to the distance between the chamber and muzzle stops 26 and 28 in the gun barrel 21. A set screw 57 is used to secure the sleeve 54 to the circular tube 55 and set the chamber plug 32 and muzzle plug 33 at the desired spacing. Since the set screw 57 also secures the circular tube 55 against rotation in the sleeve 54, the plugs 32 and 33 will rotate in unison when the block 56 is in its seat 46. Thus, the plugs 32 and 33, as shown in FIG. 3, will all rotate together. However, without the linkage 34, the block 56 can be freely withdrawn from the seat 46 to longitudinally separate the plugs 32 and 33 from each other.

Turning now to FIGS. 2, 4 and 6-15, the linkage 34 has a round shaft 71 tapered at its tip to provide a shaft guide 72. A locking member 73 is fixed to the shaft 71. Preferably, the locking member 73 is a pin which extends diametrically through the shaft 71. The other end of the shaft 71 is welded to a square tube 74 which slides on a square rod 75 to telescope the linkage 34. A lock cylinder 76 operable by a key 77 is fixed, possibly by a weld, to the end of the square rod 75. An annular channel 78 is provided on the surface of the shaft 71. Operation of the key 77 turns the linkage 34 and its locking member 73. The lock cylinder has a lock ring 79 threaded on its in-bore end.

As seen in FIG. 2, the body 51 of the muzzle plug 33 provides a housing 58 for the lock cylinder 76. The locking member housing 44 of the chamber plug 32 is hollow and forms a bearing 47 for the shaft guide 72, a circular chamber 48 to rotationally receive the locking member 73 and a diametric slot 49 to slidably pass the locking member 73 into the chamber 48. The block 56 has a longitudinal opening 59 aligned with the opening through the circular tube 55 so that the shaft 71 can extend through and rotate in the block 56 with the square tube 74 rotating in the circular tube 55. The block 56 also has a radial opening 61 extending into the longitudinal opening 59. A pin 62 is threaded into the radial opening 61. With the shaft 71 inserted into the longitudinal opening 59 in the block 56 until the opening 59 aligns with the annular channel 78 in the shaft 71, the pin 62 is screwed into the block 56 until it penetrates into but does not contact the channel 78. Thus, the linkage 34 is free to rotate in the block 56 of the muzzle plug 33 but cannot be longitudinally withdrawn from the block 56.

To install the gun barrel lock 31 in the shotgun barrel 21, the stop-to-stop distance from approximately the center of the chamber reduction 26 to the choke seat 28 is measured. The shaft guide 72 is inserted through the seat 46 into the bearing 47 until the locking member 73 has passed through the slot 49 into the chamber 48 and the block 56 is fully seated in the seat 46. The round tube 55 is inserted into the sleeve 54 and telescoped so that the distance from approximately the center of the conical surface 36 on the chamber plug 32 to the peripheral land 37 on the muzzle plug 33 is approximately the same as the measured stop-to-stop distance inside the barrel 21. The set screw 57 is tightened to secure the circular tube 55 in this position in the sleeve 54. The shaft 71 is then withdrawn from the locking member housing 44. The separated chamber and muzzle plugs 32 and 33 can now be inserted into the chamber 23 and muzzle 24 until the conical surface 36 and peripheral land 37 contact their respective stops 26 and 28. In this position, the block 56 should be fully seated in the seat 46 and the locking member 73 aligned in the circular chamber 48 of the locking member housing 44. Turning the key 77 should rotate the linkage 34 approximately ninety degrees to shift the locking member 73 out of alignment with the diametric slot 49 so that the linkage 34 cannot be disengaged from the chamber plug 32.

Figure 16:
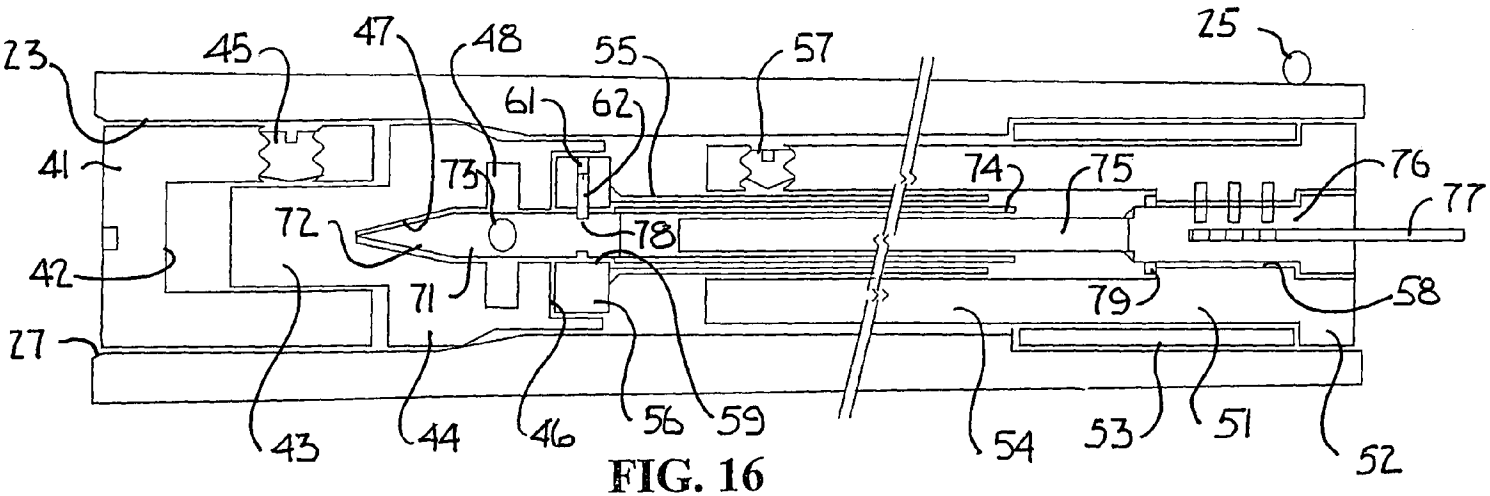
FIG. 16 is a vertical plane diametric cross-sectional view of the gun barrel lock of FIG. 2 mounted in the gun barrel of FIG. 1.

It is preferred that the length of the chamber and muzzle plugs 32 and 33 be such that, when installed in the barrel 21 as above described and as shown in FIG. 16, the entire barrel lock 31, including both plugs 32 and 33, is within the barrel 21 and no component of the barrel lock 31 is accessible outside of the barrel. Since the barrel lock 31 is free to rotate inside the barrel 21 and cannot be withdrawn from either end of the barrel 21, it is extremely difficult to tamper with the barrel lock 31 without damaging the surface of the barrel 21.

Figure 17:
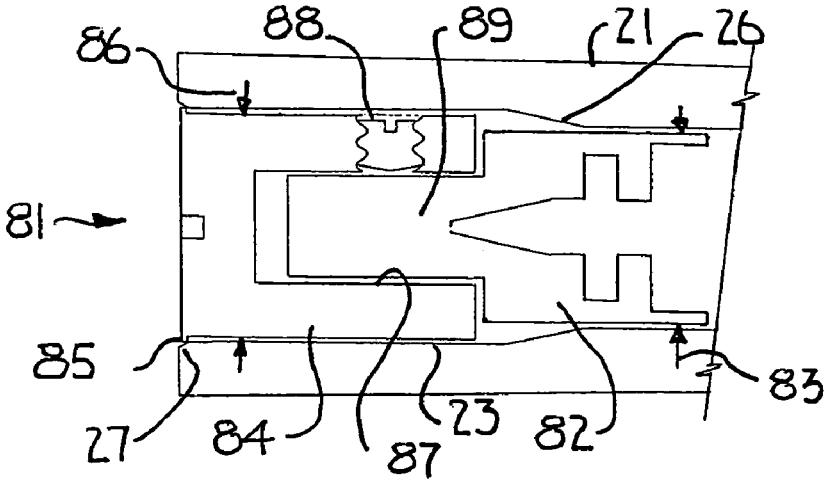
FIG. 17 is a vertical plane diametric cross-sectional view of an alternative chamber plug.

Another chamber plug 81 is illustrated in FIG. 17. The lock member housing 82 has a diameter 83 which will pass through the chamber reduction 26 of the barrel 21. The casing 84 has a flange or rim 85 which will impinge against the chamfer 27 on the chamber 23. The chamfer 27 serves as the chamber stop and the length of the barrel lock 31 is measured accordingly. The barrel lock 31 is still entirely within the barrel 21. One advantage of this type of chamber plug 81 is that casings 84 of different diameters 86 can have identical pockets 87 so that the same housing 82 can be used for a variety of casings 84 to accommodate different caliber guns. The user need only loosen the set screw 88, remove the post 89 of one housing, replace the casing 84 with one suited to the appropriate caliber and tighten its set screw 88.

Figure 18:
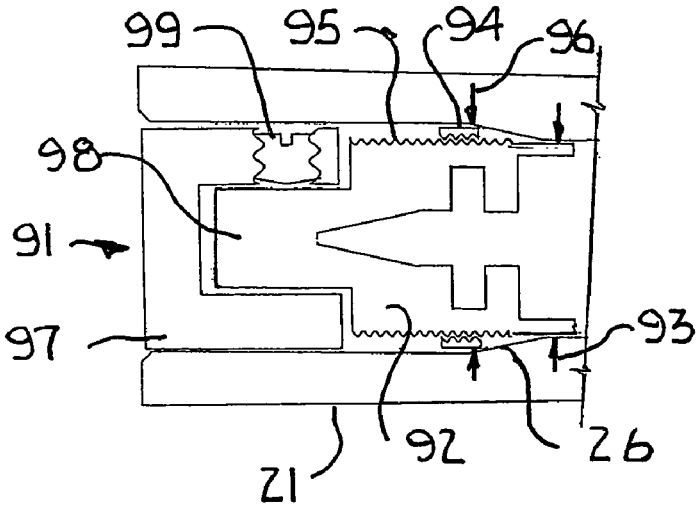
FIG. 18 is a vertical plane diametric cross-sectional view of another alternative chamber plug.

Similar interchangeability can be achieved with the type of chamber plug 91 illustrated in FIG. 18. The lock member housing 92 has a diameter 93 which will pass through the chamber reduction 26 of the barrel 21. A stop ring 94 is engaged on threads 95 on the lock member housing 92 so that its longitudinal position on the housing 92 can be adjusted. The diameter 96 of the stop ring 94 is such that it will impinge against the chamber reduction 26. The casings 97 can be interchanged on the housing posts 98 using the set screw 99 in the same manner as above described.

Figure 19:
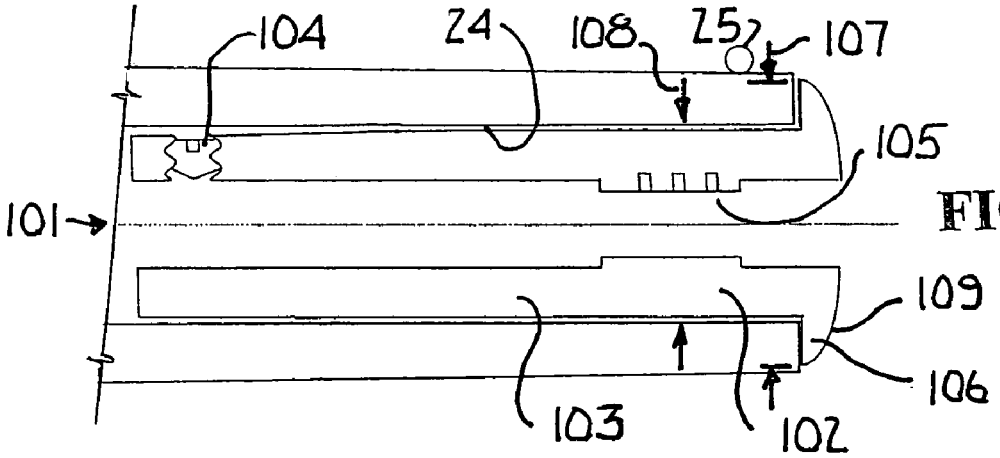
FIG. 19 is a vertical plane diametric cross-sectional view of an alternative muzzle plug.
Figure 21:
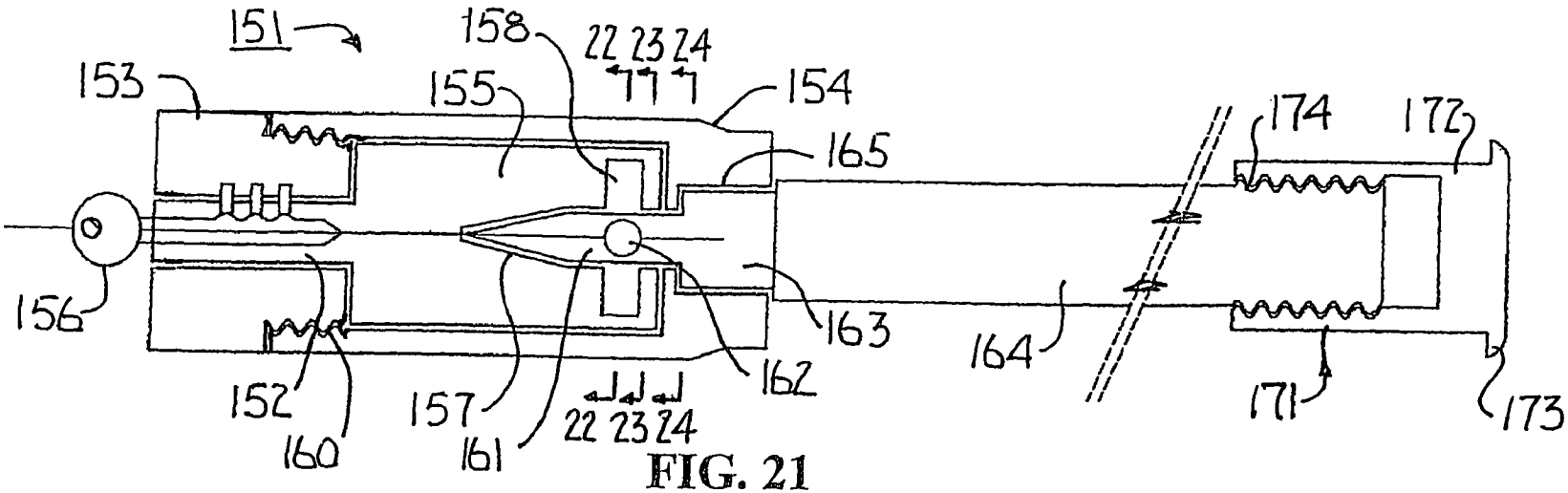
FIG. 21 is a vertical plane diametric cross-sectional view of an assembled gun barrel lock with a chamber plug lock cylinder.
Figure 24:
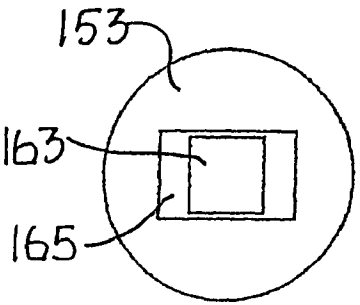
FIG. 24 is a cross-sectional view taken along the line 24-24 of FIG. 21.
Figure 23:
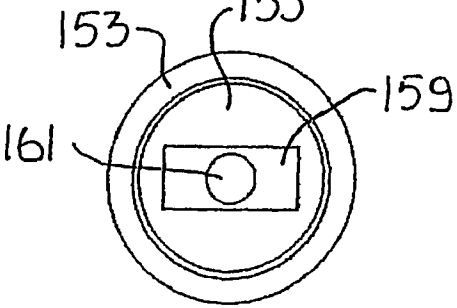
FIG. 23 is a cross-sectional view taken along the line 23-23 of FIG. 21.
Figure 22:
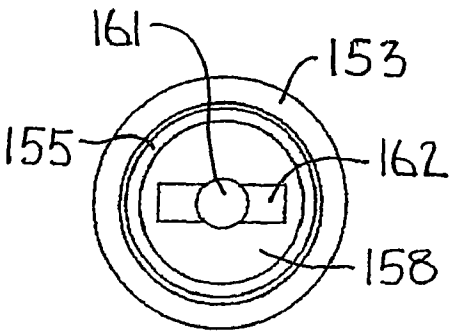
FIG. 22 is a cross-sectional view taken along the line 22-22 of FIG. 21.

Turning to FIG. 19, another type of muzzle plug 101 is illustrated which is intended for use with rifles, hand guns and, as shown, shotguns which do not have a choke seat 28 in the muzzle 24. The muzzle plug 101 has a body 102, sleeve 103 and set screw 104 with a lock cylinder housing 105 in the body 102, substantially as in the muzzle plug 33 of FIG. 2. However, the lock cylinder end of the body 102 has an annular flange 106 with a diameter 107 greater than the diameter 108 of the muzzle 24. Thus, when the sleeve 103 and body 102 are inserted into the muzzle 24, the annular flange 106 will impinge against the outer end of the muzzle 24 to prevent further insertion of the muzzle plug 101 into the barrel 21. To reduce the possibility of outside-the-bore tampering with the muzzle plug 111, the outer surface 109 of the flange 106 is arcuate so as to resist gripping of or cutting into the flange 106.

Figure 20:
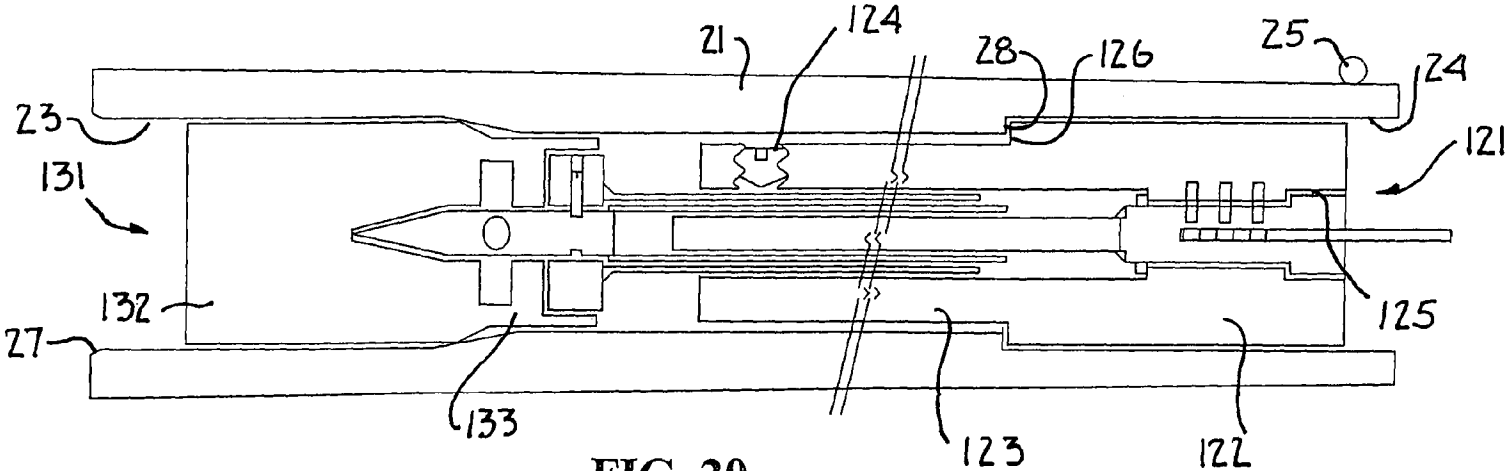
FIG. 20 is a vertical plane diametric cross-sectional view of an integral plug embodiment of the gun barrel lock.

An integral type of muzzle plug 121 is illustrated in FIG. 20. The muzzle plug 121 has a body 122, a sleeve 123 with a set screw 124 and a lock cylinder housing 125 substantially the same as the muzzle plug 33 illustrated in FIG. 3. However, the integral muzzle plug 121 does not employ a ring 53 which is interchangeable for different caliber weapons. Rather, the body 122 of the plug 121 extends to a peripheral land 126 which will impinge against the muzzle stop 28 when the muzzle plug 121 is inserted in the muzzle 24. For different caliber guns, it will be necessary, therefore, to replace the entire body 122 and sleeve 123 of the integral muzzle plug 121. Also shown is an integral type of chamber plug 131. This chamber plug 131 is similar to the plug 32 shown in FIG. 3 except the casing portion 132 and housing portion 133 are an integral unit. Similarly, the chamber plugs 32, 81 and 91 of FIGS. 3, 17 and 18 may also be integrally formed.

Looking at FIGS. 21-24, a gun barrel lock 151 is illustrated which has a lock cylinder 152 in its chamber plug 153. The chamber plug 153 has a conical surface 154 which will engage against the chamber reduction 26 of the barrel 21 shown in FIG. 1. However, in this embodiment, the lock member housing 155 extends from and rotates with the lock cylinder 152 so that the housing 155 turns with the key 156. The lock member housing 155 provides a bearing 157, a circular chamber 158 and a slot 159 similar to the muzzle lock cylinder embodiments hereinbefore described. The housing 155 can be threaded 160 to the casing end of the plug 153 to permit mounting of the lock cylinder 152. In this chamber lock cylinder embodiment, the shaft 161 on which the locking member 162 is engaged is welded or otherwise fixed at its muzzle end to a square rod 163 which is connected or welded at its other end to a circular member or tube 164. When the locking member 162 is aligned in the chamber 158 in the lock member housing 155, the square rod 163 is fully inserted into a seat 165 so that the chamber plug 153, the locking member 162, the square rod 163 and square tube 164 rotate in unison but independently of the lock member housing 155 and key 156. When the key 156 is turned, the lock member housing 155 turns and the locking member 162 engages in the circular chamber 158 to prevent separation of the chamber plug 153 from the muzzle plug 171. In this embodiment, the muzzle plug 171 as shown has a body 172 with a flange 173 for engaging on the end of the muzzle 24, as was illustrated and described in greater detail in relation to FIG. 19. The flanged plug 171 is internally threaded to engage an external thread 174 on the muzzle end of the circular member 164. Any of the embodiments of the muzzle plugs illustrated in FIGS. 16, 19 and 20 could also be used. Similarly, features of other embodiments of the chamber plugs, such as the threaded embodiment of FIG. 18, can be incorporated into the lock cylinder chamber plug 153. The length of the gun barrel lock 151 can be changed, for example by rotating the muzzle plug 171 on the threads 174 as shown or by telescoping the rod 163 or member 164 as hereinbefore discussed with respect to other embodiments of the gun barrel lock.

The invention has been described in relation to use with a shotgun barrel. However, the barrel lock is useful with handguns and rifles as well. While it has been described in relation to the lock cylinder being on the muzzle end and the lock member being on the chamber end, this relationship can be reversed or, as illustrated in FIGS. 21-24, combined in one plug. Different types of chamber and muzzle plugs can be interchanged to suit the gun to which the lock is applied. If a given barrel lock is always used with the same gun, it is not necessary to change the length of the plugs or linkage once they have been set. On the other hand, if the user wishes to switch the same barrel lock from one gun to another, the set screw adjustments readily permit changing the length of the gun lock to accommodate the length of the barrel. Furthermore, one or both of the plugs can be exchanged to accommodate specific calibers of weapons and, most preferably, muzzle rings can be changed and chamber plugs adjusted to more easily accommodate the change in caliber. All threaded engagements are preferably sealed to prevent unauthorized disengagement of the threads.

Thus, it is apparent that there has been provided, in accordance with the invention, a motor vehicle radiator shield that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A gun barrel lock comprising:

a first plug insertable in a longitudinal direction into a chamber end of the gun barrel, said first plug being adapted to impinge during motion in said direction against a portion of the barrel so as to stop travel of said first plug into said barrel;

a second plug insertable in an opposite longitudinal direction into a muzzle end of the gun barrel, said second plug being adapted to impinge during motion in said opposite direction against a portion of the barrel so as to stop travel of said second plug into said barrel;

a linkage fixed at one end to one of said plugs for extension to and adapted at another end for engagement with another of said plugs whereby said impingement of each said plug prevents removal of the other of said plugs from the barrel; and means for locking said linkage to said another of said plugs to prevent unauthorized disengagement of said another of said plugs from said linkage.

2. A gun barrel lock according to claim 1, said linkage being of adjustable length.

3. A gun barrel lock according to claim 1, one of said plugs having a flange for impingement against an outer end of said barrel.

4. A gun barrel lock according to claim 1, each of said plugs having a flange for impingement against its respective outer end of said barrel.

5. A gun barrel lock according to claim 1, the chamber end of the barrel having a diameter reduction at an in-barrel end thereof and said first plug having a stop for impingement against the reduction.

6. A gun barrel lock according to claim 1, the barrel having a choke seat in the muzzle end thereof and said second plug having a stop for impingement against the choke seat.

7. A gun barrel lock according to claim 1, the chamber end of the barrel having a diameter reduction at an in-barrel end thereof and said first plug having a stop for impingement against the reduction and the barrel having a choke seat in the muzzle end thereof and said second plug having a stop for impingement against the choke seat.

8. A gun barrel according to claim 1, said locking means comprising a lock cylinder mounted for rotation in one of said plugs about an axis parallel to said longitudinal direction and a locking member chamber in another of said plugs and said linkage comprising a shaft fixed at one end to said lock cylinder for rotation therewith and extending to a locking member at another end thereof, said locking member being longitudinally insertable into said locking member chamber and rotationally engagable in said locking member chamber.

9. A gun barrel lock according to claim 8, said locking means further comprising a key.

10. A gun barrel lock according to claim 8, said shaft being of adjustable length.

11. A gun barrel lock according to claim 1, said first plug having a casing with a pocket therein, a housing with a post extending therefrom seatable in said pocket and means for fixing said post to said pocket at fully and partially seated positions therein.

12. A gun barrel lock according to claim 11, said first plug having a plurality of casings, each said casing having a different outer diameter for use with a gun barrel of corresponding caliber and all of said casings having identical pockets.

13. A gun barrel lock according to claim 1, said second plug having a body with a ring thereabout.

14. A gun barrel lock according to claim 13, said second plug having a plurality of rings, each said ring having a different outer diameter for use with a gun barrel of corresponding muzzle diameter and all of said rings having identical inside diameters.

15. A gun barrel lock according to claim 1, said first plug having a casing with a pocket therein, a housing with a post extending therefrom seatable in said pocket and means for fixing said post to said pocket at fully and partially seated positions therein and said second plug having a body with a ring thereabout.

16. For a gun barrel having a bore, a chamber with a diameter reduction at an in-barrel end thereof and a muzzle with a choke seat therein, a lock comprising:

a first plug insertable in a longitudinal direction into the chamber of the gun barrel, said first plug being adapted to impinge during motion in said direction against the reduction so as to stop travel of said first plug into said barrel with said first plug disposed entirely within the bore;

a second plug insertable in an opposite longitudinal direction into the muzzle of the gun barrel, said second plug being adapted to impinge during motion in said opposite direction against said choke seat so as to stop travel of said second plug into said barrel with said second plug disposed entirely within the bore;

a linkage fixed at one end to one of said plugs for extension to and adapted at another end for engagement with another of said plugs whereby said impingement of each said plug prevents withdrawal of the other of said plugs outside of the bore; and means for locking said linkage to said another of said plugs to prevent unauthorized disengagement of said another of said plugs from said linkage.

17. A gun barrel lock according to claim 16, said locking means comprising a lock cylinder mounted for rotation in one of said plugs about an axis parallel to said longitudinal direction and a locking member chamber fixed in another of said plugs and said linkage comprising a shaft fixed at one end to said lock cylinder for rotation therewith and extending to a locking member at another end thereof, said locking member being longitudinally insertable into said locking member chamber and rotationally engagable in said locking member chamber.

18. A gun barrel lock according to claim 17, said locking means further comprising a key.

19. A gun barrel lock according to claim 18, said lock cylinder plug being telescopic with a means for fixing a length of said lock cylinder plug and having an in-barrel end adapted to horizontally engage with said locking member chamber plug whereby said plugs rotate about said axis in unison.

20. A gun barrel lock according to claim 19, said shaft telescopically extending from said lock cylinder to said locking member.

21. A gun barrel lock according to claim 20, said locking member chamber plug having a casing with a pocket therein, a housing with a post extending therefrom seatable in said pocket and means for fixing said post to said pocket at fully and partially seated positions therein.

22. A gun barrel lock according to claim 21, said locking member chamber plug having a plurality of casings, each said casing having a different outer diameter for use with a gun barrel of corresponding diameter and all of said casings having identical pockets.

23. A gun barrel lock comprising:

a first plug insertable in a longitudinal direction into a chamber end of the gun barrel, said first plug being adapted to impinge during motion in said direction against a portion of the barrel so as to stop travel of said first plug into said barrel;

a second plug insertable in an opposite longitudinal direction into a muzzle end of the gun barrel, said second plug being adapted to impinge during motion in said opposite direction against a portion of the barrel so as to stop travel of said second plug into said barrel;

cooperative means on in-bore ends of each said plug for mating said plugs for simultaneous rotation about an axis in said longitudinal direction;

a linkage journalled at one end on one of said plugs for extension into another of said plugs; and cooperative means on said linkage and said another of said plugs for coupling said plugs against longitudinal separation, whereby said impingement of each said plug prevents removal of the other of said plugs from the barrel.

24. A gun barrel lock according to claim 23 further comprising means for locking said linkage against rotation in said one of said plugs to prevent unauthorized disengagement of said another of said plugs from said linkage.

25. A gun barrel lock comprising:

a first plug insertable in a longitudinal direction into a chamber end of the gun barrel, said first plug being adapted to impinge during motion in said direction against a portion of the barrel so as to stop travel of said first plug into said barrel and having a lock cylinder mounted for rotation therein about an axis parallel to said longitudinal direction, said lock cylinder having a locking member seat in an in-bore end thereof; and a second plug insertable in an opposite longitudinal direction into a muzzle end of the gun barrel, said second plug being adapted to impinge during motion in said opposite direction against a portion of the barrel so as to stop travel of said second plug into said barrel, said second plug having a shaft extending to a locking member fixed at an in-bore end thereof, said locking member being longitudinally insertable into and engagable for rotation with said locking member seat for coupling said plugs against longitudinal separation, whereby said impingement of each said plug prevents removal of the other of said plugs from the barrel.

26. A gun barrel lock according to claim 25 further comprising means for locking said lock cylinder against rotation in said first plug to prevent unauthorized disengagement of said seat from said locking member.

* * * * *